United States Patent [19]

Outram

[11] 4,074,493

[45] Feb. 21, 1978

[54] CONNECTING REINFORCING BARS IN AN ACCESS HOLE

[75] Inventor: Christopher David Outram, Thames Ditton, England

[73] Assignee: CCL Systems Limited, England

[21] Appl. No.: 732,578

[22] Filed: Oct. 15, 1976

[30] Foreign Application Priority Data

Oct. 15, 1975 United Kingdom ..... 42357/75

[51] Int. Cl.[2] ..... E04C 1/10

[52] U.S. Cl. ..... 52/583; 52/741

[58] Field of Search ..... 52/223 L, 223 R, 227, 52/587, 583, 741; 403/43, 44

[56] References Cited

U.S. PATENT DOCUMENTS

| | | | |
|---|---|---|---|
| 818,884 | 4/1906 | Grimm | 52/583 X |
| 2,611,262 | 9/1952 | Dodson et al. | 52/583 X |
| 3,089,215 | 5/1963 | Stubbs | 52/223 R X |
| 3,952,468 | 4/1976 | Soum | 52/223 R X |

FOREIGN PATENT DOCUMENTS

| | | | |
|---|---|---|---|
| 869,696 | 6/1961 | United Kingdom | 52/583 |

*Primary Examiner*—Price C. Faw, Jr.
*Assistant Examiner*—Carl D. Friedman
*Attorney, Agent, or Firm*—Caesar, Rivise, Bernstein & Cohen, Ltd.

[57] ABSTRACT

Connecting reinforcing bars in an access hole by a method and means which comprises:

(1) securing to each first bar by a radial compression the unthreaded portion of a first partially internally threaded sleeve, (2) securing to each end of a connecting bar the unthreaded portion of a second partially internally threaded sleeve, the connecting bar being of a length slightly less than that between the sides of the hole, (3) locating in the threaded portion of the second sleeves at each end of the connecting bar a threaded high tensile externally threaded stud and locating the connecting bar between the first bars in the sides of the hole, (4) rotating each stud to engage a threaded sleeve secured to a first bar so to bridge the gap between the first bars by means of the connecting bar.

8 Claims, 2 Drawing Figures

CONNECTING REINFORCING BARS IN AN ACCESS HOLE

Figure 1:
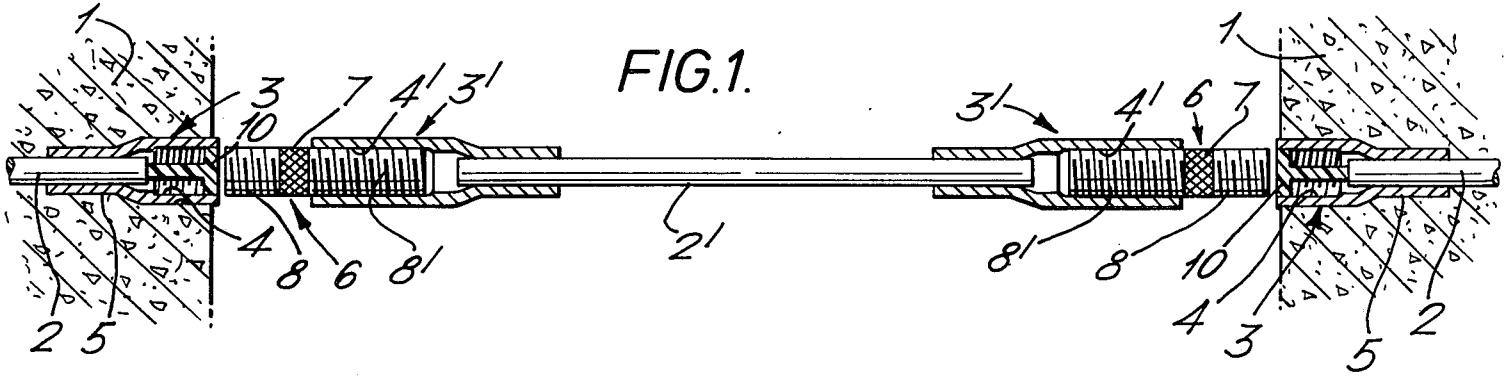

This invention relates to concrete bodies strengthened with reinforcing bars. It is often necessary when making one such body or joining two of them together to leave a hole for access or inspection. The hole may later be filled in with concrete or where access is required permanently the hole may be provided with a demountable cover.

The metal reinforcement bridging the hole must keep its tensile strength and often such holes are located at the interconnection of two lengths of bar which must accordingly be joined in the hole. One way of making the connection is to "lap" the bars which means overlapping one on another, if necessary cranking one (or each) bar to assume the required position. To ensure that the joint has the necessary tensile strength the length of the overlap must be at least 40 times the diameter of the bar. This means however that a bulky connection is formed, and this must be accommodated in the hole the size of which is accordingly increased over and above that required solely for the purposes of access and inspection.

According to the invention, a method and an assembly for making a connection between first reinforcing bars located on opposite sides of an access hole, comprises 1. securing to each first bar by a radial compression the unthreaded portion of a first partially internally threaded sleeve, 2. securing to each end of a connecting bar the unthreaded portion of a second partially internally threaded sleeve, the connecting bar being of a length slightly less than that between the sides of the hole, 3. locating in the threaded portion of the second sleeves at each end of the connecting bar a threaded high tensile externally threaded stud and locating the connecting bar between the first bars in the sides of the hole, 4. rotating each stud to engage a threaded sleeve secured to a first bar so to bridge the gap between the first bars by means of the connecting bar.

Preferrably the externally threaded portion of the second sleeves secured to each end of the connecting bar is of a length greater than that of the externally threaded portion of the corresponding sleeve secured to the bar in the concrete. Also, preferably the stud within this longer sleeve has two internally threaded portions of unequal length, one (the smaller) being dimensioned to be received in the threaded portion of the corresponding sleeve secured to the first bar which is in the concrete. The term "stud" is used to cover a short length or rod, bar, bolt or the like whether solid or hollow.

The internally threaded portions of the second sleeves attached to the connecting bar may be preferably of a shorter length than and threaded with a hand opposite to all the other sleeves in the assembly. The corresponding stud may have two threaded portions of equal length but threaded in opposite hands.

The invention includes an assembly comprising a bar to each end of which is secured a sleeve by radial compression, the sleeve having a threaded portion extending beyond the end of the bar and preferably containing a threaded bolt or stud.

Figure 2:
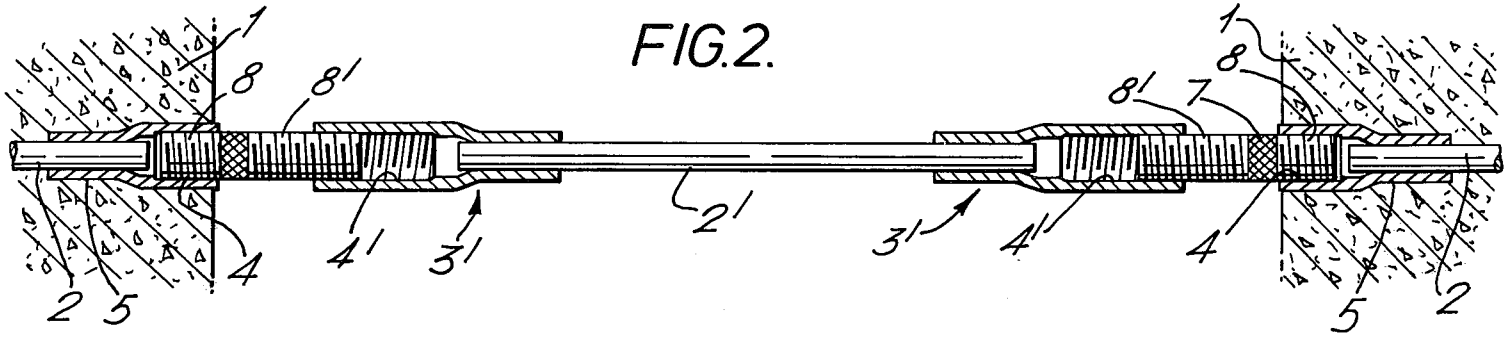

An embodiment of the invention is illustrated by the accompanying diagrammatic drawing in which FIG. 1 shows a connection about to be made and FIG. 2 shows a formed connection.

The access hole is formed of two opposite bodies of cast concrete 1 separated by a distance of from about 50 cm to 5 meters. A reinforcing bar 2 say 16 to 40mm diameter is cast into each body 1 and adjacent the free end is connected to a first sleeve 3 which is internally threaded.

The sleeve 3 has an internally threaded portion 4 and an unthreaded rear portion 5 which was radially compressed on to the bar before the bar was cast into the concrete 1.

A connecting assembly comprises a length of connecting bar 2' to each end of which has been secured by radial compression a sleeve 3'. The sleeves 3' are the same as the sleeves 3 save that the length of the threaded portion 4' in a second embodiment of the invention will extend beyond the end of the connecting bar 2' is longer by about twice. A threaded high tensile stud 6 has an external knurled part 7 between its ends dividing the bolt into two unequal threaded portions 8 and 8', the portion 8 being dimensioned so as to be received in a portion 4 of a sleeve 3 secured to a bar 2.

In operation, the sleeves 3 are soft metal and are compressed on to the bars and concrete is then cast to form the bodies 1. The mouth of each sleeve 3 is protected against the ingress of dirt etc. by a demountable plastics cap 10. The caps are removed and the assembly is then located in position so that a stud (already secured to connecting bar 2') is in axial alignment with a sleeve 3. Each stud is then successively rotated by gripping the knurled portion 7 in turn to cause the threaded portion 8 to be received in a respective threaded portion 4 of sleeve 3, so locking the bar 2' to the bars 2. In this way the reinforcement extends across the access hole without forming a bulky connection.

The sleeves 3' may be of different hands to facilitate engagement of the bolts with the sleeves 3. The bar 2' may be replaced by other intermediate structures, although for economy and effectiveness it is most likely to be of the same steel material as the bars 2.

Without further elaboration the foregoing will so fully illustrate my invention that others may, by applying current or future knowledge, readily adapt the same for use under various conditions of service.

What is claimed as the invention is:

1. In a structure comprising a pair of concrete bodies strengthened with reinforcing bars, said bodies having an access hole formed therebetween, with said reinforcing bars terminating adjacent said access hole, and being aligned on opposite sides of said access hole, the improvement comprising a sleeve secured on the end of each reinforcing bar adjacent said hole, each of said sleeves being internally threaded and being in communication with said access hole, a connecting bar having a length slightly less than the width of said hole and being positioned between the ends of said reinforcing bars, said connecting bar being provided at each end with an internally threaded sleeve, threaded studs being threadedly secured in said first mentioned sleeves and said internally threaded sleeves to connect said connecting bar with said reinforcing bars, and said reinforcing bars, connecting bar and studs being in alignment.

2. The structure of claim 1 wherein said bar threaded sleeves are internally threaded and said studs are externally threaded.

3. The structure of claim 2 wherein the connecting bar sleeves have a threaded portion of a length longer than the threaded portion of the first bar threaded sleeves.

4. The structure of claim 3 wherein the threading of that portion of the stud received within the connecting bar sleeves is longer than the threaded portion at the other end of the stud.

5. The structure of claim 4 wherein the threads of the connecting bar sleeves are of a hand opposite to other threads.

6. The structure of claim 2 wherein the length of the threaded portion of the connecting bar sleeves which will extend beyond the end of the connecting bar is longer by about twice.

7. The structure of claim 1 wherein the sleeves are of soft metal.

8. A method of connecting aligned reinforcing bars in an access hole between a pair of concrete bodies comprising securing to each reinforcing bar the unthreaded portion of a first partially internally threaded sleeve, securing to each end of a connecting bar between the reinforcing bars the unthreaded portion of a second partially internally threaded sleeve, with the connecting bar being of a length slightly less than the distance between the size of the hole, locating in the threaded portion of the second sleeves at each end of the connecting bar an externally threaded stud, and locating the connecting bar between the first reinforcing bars in the sides of the hole, and rotating each stud to engage the threaded sleeve to the reinforcing bar so as to bridge the gap between the reinforcing bars by means of the connecting bar.

* * * * *